US009039164B2

(12) United States Patent
Hanamura

(10) Patent No.: US 9,039,164 B2
(45) Date of Patent: May 26, 2015

(54) LIQUID EJECTING APPARATUS

(75) Inventor: Osamu Hanamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 13/594,355

(22) Filed: Aug. 24, 2012

(65) Prior Publication Data

US 2013/0050330 A1 Feb. 28, 2013

(30) Foreign Application Priority Data

Aug. 26, 2011 (JP) ..... 2011-184475

(51) Int. Cl.

| | |
|---|---|
| ***B41J 2/01*** | (2006.01) |
| ***B41J 29/393*** | (2006.01) |
| ***B41J 11/00*** | (2006.01) |
| ***B41J 11/057*** | (2006.01) |

(52) U.S. Cl.

CPC ..... *B41J 11/0095* (2013.01); *B41J 11/057* (2013.01)

(58) Field of Classification Search

CPC ..... B41J 11/0095

See application file for complete search history.

(56) References Cited

U.S. PATENT DOCUMENTS

| | | | | |
|---|---|---|---|---|
| 5,764,251 | A * | 6/1998 | Hashimoto | 347/16 |
| 6,832,825 | B1 * | 12/2004 | Nishikori et al. | 347/19 |
| 6,998,628 | B2 * | 2/2006 | Chelvayohan | 250/559.01 |
| 2007/0229573 | A1 * | 10/2007 | Takeishi et al. | 347/19 |
| 2008/0036814 | A1 | 2/2008 | Takeishi et al. | |

FOREIGN PATENT DOCUMENTS

| | | | |
|---|---|---|---|
| JP | 2002-127521 | | 5/2002 |
| JP | 2010194748 | A * | 9/2010 |

* cited by examiner

*Primary Examiner* — Shelby Fidler
*Assistant Examiner* — Tracey McMillion
(74) *Attorney, Agent, or Firm* — Workman Nydegger

(57) ABSTRACT

A liquid ejecting apparatus includes a liquid ejecting head which ejects liquid toward a recording medium; a rib which projects in a direction toward the liquid ejecting head, and includes a support portion for supporting the recording medium; a detection target portion which is provided at a position lower than the support portion; a lower side portion located at a position lower than the detection target portion; a light emitting unit which irradiates the detection target portion with light rays; a light receiving unit which receives reflected light rays resulting from reflection of the light rays with which the detection target portion is irradiated, convers the received reflected light rays into photocurrent, and outputs the photocurrent as an output voltage; and a sensitivity setting unit which causes the light emitting unit to irradiate the detection target portion with light rays and sets the sensitivity of the light receiving unit.

8 Claims, 13 Drawing Sheets

LIQUID EJECTING APPARATUS

This application claims the benefit of Japanese Patent Application No. 2011-184475, filed on Aug. 26, 2011, which is hereby incorporated by reference herein in its entirety.

BACKGROUND

1. Technical Field

The present invention relates to a liquid ejecting apparatus.

2. Related Art

An ink jet type printer, which is an example of a liquid ejecting apparatus, forms images on a record medium, such as print paper, by causing a liquid ejecting head to eject ink onto the record medium which is transported in conjunction with reciprocation of a carriage provided with the liquid ejecting head. Known examples of such an ink jet type printer include one which has a carriage provided with a light emitting unit, such as a light emitting diode, and a light receiving unit, such as a phototransistor, and detects the position of an edge portion of print paper in a transported state by causing the light receiving unit to receive reflected light rays resulting from reflection of light rays emitted from the light emitting unit.

The position of an edge portion of print paper is detected by comparing the voltage value of an output voltage outputted from the light receiving unit with a preset threshold value. However, a long-term use of such an ink jet type printer causes ink mists, which are formed by the ejection of ink from the liquid ejecting head, to adhere to the surface of the light receiving unit, and this adhesion of ink mists leads to a reduction of accuracy in the detection of the position of an edge portion of print paper.

Therefore, in JP-A-2002-127521, there has been disclosed a method in which, by using a sensor functioning as a light receiving unit, a threshold value is determined on the basis of a detection amount resulting from detection on print paper and a detection amount resulting from detection outside the print paper.

FIG. 14 is a graph illustrating photocurrent flowing at a light receiving unit and an output voltage outputted from the light receiving unit, in an existing ink jet type printer. An output voltage VH denoted by the full line indicates an output voltage which is outputted from a light receiving unit as the result of reflection at a spot outside print paper, and an output voltage VP denoted by the one-dot chain line indicates an output voltage which is outputted from the light receiving unit as the result of reflection at a spot on the print paper. A threshold value VS denoted by the dotted line indicates an output voltage whose voltage value is 50 percent of that of the output voltage VH.

Such an ink jet type printer compares the voltage value of an output voltage outputted from the light receiving unit with a threshold value, and thereby, detects the edge portion of print paper. Specifically, if the voltage value of the output voltage outputted from the light receiving unit is smaller than the threshold value VS, it is deemed that the output voltage VP, which is the output voltage outputted from the light receiving unit as the result of reflection at a spot on print paper, has been detected, and the ink jet type printer determines that the edge portion of print paper has been detected. In contrast, if the voltage value of the output voltage outputted from the light receiving unit is larger than or equal to the threshold value VS, it is deemed that the output voltage VH, which is the output voltage outputted from the light receiving unit as the result of reflection at a spot outside the print paper, has been detected, and the ink jet type printer determines that the edge portion of print paper has not been detected.

With the increase of the amount of ink mists adhered to the light receiving unit, the amount of photocurrent decreases. As shown in FIG. 14, the output voltage VH, which is the output voltage detected as the result of reflection at a spot outside print paper, increases along with the decrease of the amount of photocurrent. Therefore, the threshold value VS also increases along with the decrease of the amount of photocurrent.

With the further decrease of the amount of photocurrent due to the increase of the amount of ink mists adhered to the light receiving unit, the output voltage VP, which is the output voltage outputted as the result of reflection at a spot on print paper, rapidly rises up, so that, at a photocurrent amount value Ic9, the output voltage VP has the same value as the threshold value VS. With the decrease of the amount of photocurrent further than the photocurrent amount value Ic9, the output voltage VP exceeds the threshold value VS. Therefore, under the state where photocurrent having an amount smaller than the photocurrent amount value Ic9 is flowing at the light receiving unit, any output voltage outputted from the light receiving unit as the result of reflection at a spot on the edge portion of print paper has a voltage value exceeding the threshold value, and as a result, the ink jet type printer determines that the edge portion of the print paper does not exist.

As described above, there has been a problem that, under the state where the amount of ink mists adhered to a light receiving unit has increased, it is difficult for such an existing ink jet type printer to detect the edge portion of print paper merely by comparing the voltage value of an output voltage outputted from the light receiving unit with a threshold value.

SUMMARY

An advantage of some aspects of the invention is to provide a liquid ejection apparatus which enables solution of at least part of the foregoing problem. The invention can be realized as the following application examples and embodiments.

First Application Example

A liquid ejecting apparatus according to this first application example includes a liquid ejecting head which ejects liquid toward a recording medium; a rib which projects in a direction toward the liquid ejecting head, and includes a support portion for supporting the recording medium; a detection target portion which is provided at a position lower than the support portion; a lower side portion located at a position lower than the detection target portion; a light emitting unit which irradiates the detection target portion with light rays; a light receiving unit which receives reflected light rays resulting from reflection of the light rays with which the detection target portion is irradiated, convers the received reflected light rays into photocurrent, and outputs the photocurrent as an output voltage; and a sensitivity setting unit which causes the light emitting unit to irradiate the detection target portion with light rays, causes the light receiving unit to receive reflected light rays resulting from reflection at the detection target portion and output a first output voltage, and sets the sensitivity of the light receiving unit on the basis of the first output voltage.

According to this application example, a liquid ejecting apparatus includes a sensitivity setting unit which causes the light emitting unit to irradiate the detection target portion with light rays, causes the light receiving unit to receive reflected light rays resulting from reflection at the detection target portion and output a first voltage, and sets the sensitivity of the light receiving unit on the basis of the first output voltage.

Further, the detection target portion is provided at a position lower than the support portion. Therefore, it is possible to suppress the wear of the detection target portion caused by the recording medium in a transported state. In this way, it is possible to determine the state where the light emitting unit has deteriorated because of the adhesion of suspended particles to the light receiving unit.

Second Application Example

Preferably, the sensitivity setting unit causes the light emitting unit to irradiate the lower side portion with light rays, causes the light receiving unit to receive reflected light rays resulting from reflection at the lower side portion and output a second output voltage, acquires the second output voltage, and sets the sensitivity of the light receiving unit on the basis of a difference between the first output voltage and the second output voltage.

According to this application example, it is possible to increase the accuracy of determination of the deterioration state due to the adhesion of suspended particles to the light receiving unit.

Third Application Example

The detection target portion may be located at a position outer than a liquid ejection area, onto which liquid is ejected by the liquid ejecting head, in a transporting direction along which the recording medium is transported.

According to this application example, it is possible to prevent the adhesion of liquid ejected from the liquid ejecting head to the detection target portion.

Fourth Application Example

The liquid ejecting apparatus may further include a carriage which reciprocates in a direction intersecting with the transporting direction along which the recording medium is transported, and the detection target portion may be located inside a transportation area, within which the recording medium is transported, in the reciprocating direction.

According to this application example, since the detection target portion is covered by the recording medium in a transported state, it is possible to prevent the adhesion of suspended particles to the detection target portion.

Fifth Application Example

The transportation area may be located at a central portion in the reciprocating direction.

According to this application example, since the detection target portion is covered by the recording medium in a transported state, it is possible to prevent the adhesion of suspended particles to the detection target portion.

Sixth Application Example

The transportation area may be located at one side in the reciprocating direction.

According to this application example, since the detection target portion is covered by the recording medium in a transported state, it is possible to prevent the adhesion of suspended particles to the detection target portion.

Seventh Application Example

The detection target portion may be provided with a flat portion.

According to this application example, a reflectance regarding reflection caused by the detection target portion irradiated with light rays emitted from the light emitting unit is made higher.

Eighth Application Example

The flat portion may be in a mirror-like state.

According to this application example, a reflectance regarding reflection caused by the detection target portion irradiated with light rays emitted from the light emitting unit is made further higher.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments according to the invention will be described with reference to the drawings.

First Embodiment

Figure 1:
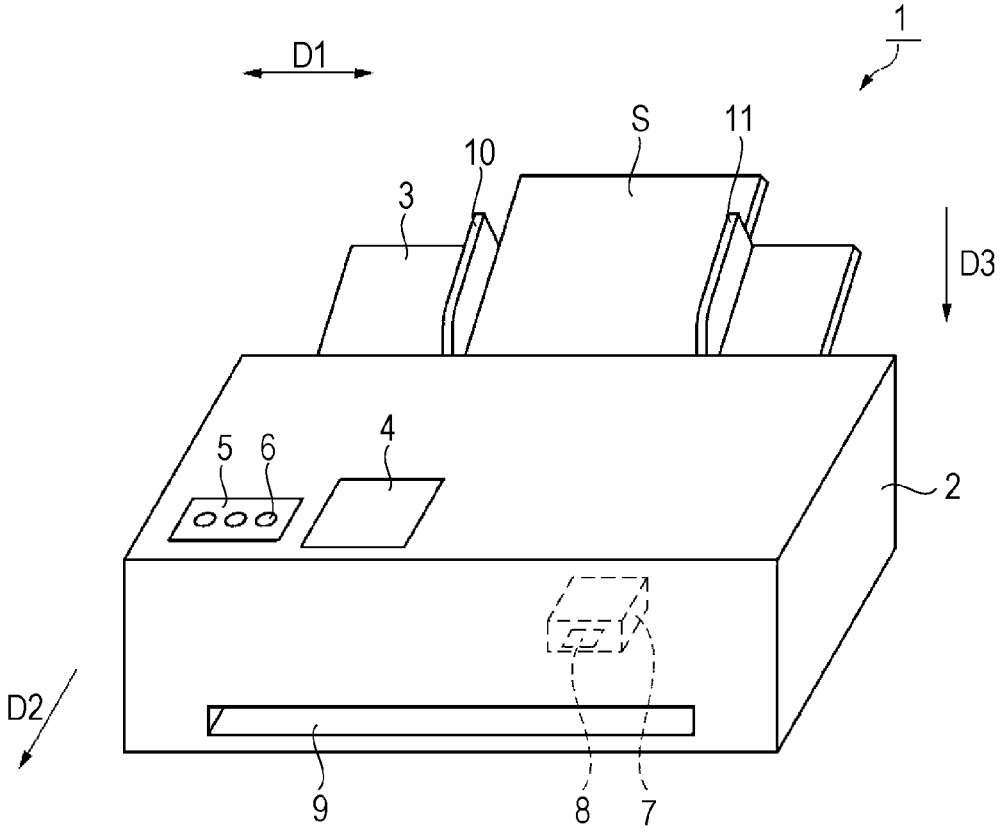
FIG. 1 is an external perspective view of an ink jet type printer according to a first embodiment of the invention.

FIG. 1 is an external perspective view of an ink jet type printer (hereinafter, referred to as a printer) 1 which is an example of a liquid ejecting apparatus. A body 2 is provided with an operation panel 5, and a display unit 4 constituted by a liquid crystal panel or the like. Users perform, for example, turning on/off of the electric power of the printer 1 by operating an operation button 6 provided on the operation panel 5, or performs print setting while seeing print setting conditions indicated on the display unit 4 constituted by a liquid crystal panel or the like.

At the back side of the body 2, a paper support 3 used for placing print paper S as a record medium thereon is provided. The print paper S is fed into the body 2 on a sheet-by-sheet basis by a paper feeding device (not illustrated) provided inside the body 2.

On the paper support 3, paper guides 10 and 11 for controlling the position of the print paper S in a reciprocating direction D1 are provided. It is possible to adjust the positions of the paper guides 10 and 11 in accordance with the dimension of the width of print paper S in the reciprocating direction D1 by sliding each of the paper guides 10 and 11 in the reciprocating direction D1.

Inside the body 2, a carriage 7 reciprocating in the reciprocating direction D1 is provided. At the lower portion of the carriage 7 in a vertical direction D3, a liquid ejecting head 8 for ejecting ink as the liquid is provided.

The print paper S, which has been fed into the body 2, is subjected to ejection of ink from the liquid ejecting head 8 reciprocating in the reciprocating direction D1 while being transported in a transporting direction D2, whereby characters and images are formed on the print paper S. The print paper S, on which images have been formed, is ejected from an ejection opening 9 in the transporting direction D2.

Figure 2:
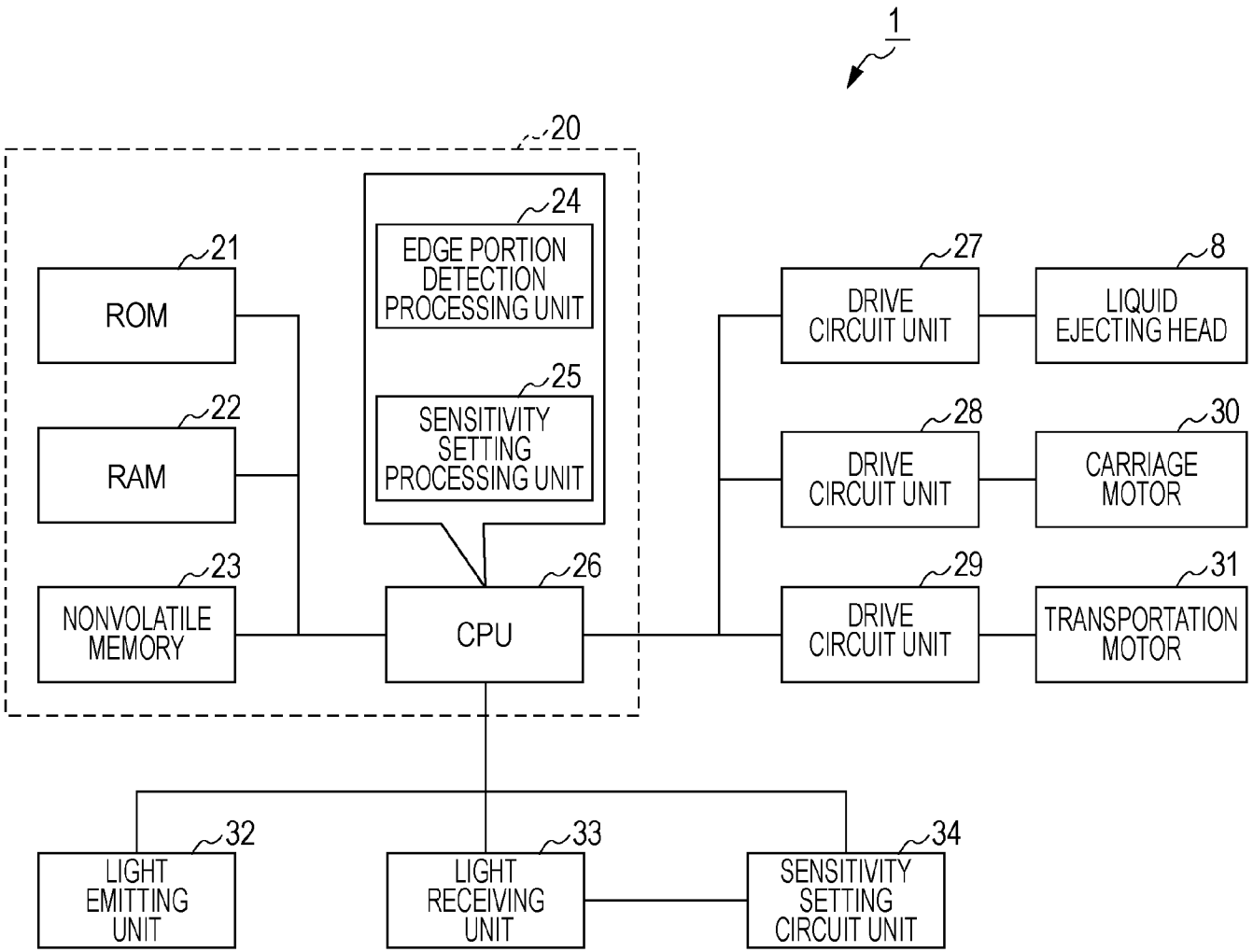
FIG. 2 is a block diagram illustrating an electric configuration of an ink jet type printer according to a first embodiment of the invention.

FIG. 2 is a block diagram illustrating an electric configuration of the printer 1. A control unit 20 includes a CPU 26, a ROM 21, a RAM 22 and a nonvolatile memory 23, and the CPU 26 reads out programs from the ROM 21 and executes the programs on the RAM 22. The nonvolatile memory 23 stores therein parameters and the like used for execution of various programs, and retains the storage content even after having been powered off.

The control unit 20 performs drive control of the liquid ejecting head 8 via a drive circuit unit 27, and thereby, causes the liquid ejecting head 8 to eject ink. The control unit 20 performs drive control of a carriage motor 30 via a drive circuit unit 28, and thereby, causes the carriage 7 to reciprocate in the reciprocating direction D1. The control unit 20 performs drive control of a transportation motor 31 via a drive circuit unit 29, and thereby, causes the print paper S to transport in the transporting direction D2.

An edge portion detection processing unit 24 detects the edge portion of the print paper S in a transported state. A sensitivity setting processing 25 performs setting of a light receiving unit 33 by applying a control signal to a sensitivity setting circuit 34. The edge portion detection processing unit 24 and the sensitivity setting processing unit 25 function by causing the CPU 26 to read out programs from the ROM 21 and execute the programs on the RAM 22.

Figure 3:
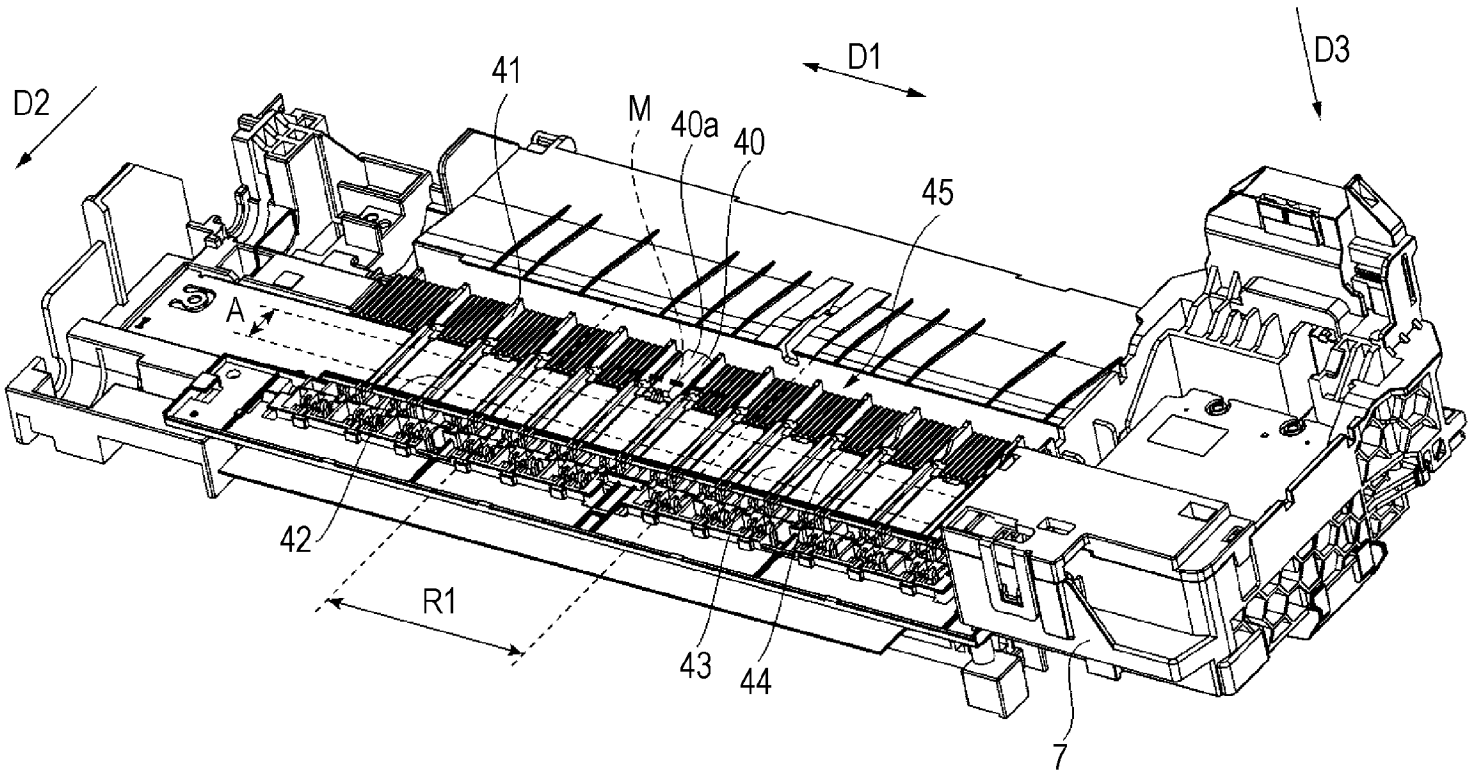
FIG. 3 is a perspective view of a support portion and a carriage according to a first embodiment of the invention.

FIG. 3 is a perspective view of a support portion 45 and the carriage 7 under the state where the body 2 of the printer 1 shown in FIG. 1 is removed. At the upper portion of the carriage 7 in the vertical direction D3, ink cartridges (not illustrated) are mounted so as to be attachable and detachable.

On the support portion 45, an upstream support face 44, which is located upstream in the transporting direction D2, and a downstream support face 43, which is located downstream in the transporting direction D2, are formed. On the upstream support face 44, upstream ribs 41, each projecting upward in the vertical direction D3 and extending in the transporting direction D2, are provided. On the downstream support face 43, downstream ribs 42, each projecting upward in the vertical direction D3, and extending in the transporting direction D2, are provided.

The upstream ribs 41 and the downstream ribs 42 support the print paper S in a transported state from the downside in the vertical direction D3, and the print paper S shown in FIG. 1 is transported along the upstream ribs 41 and the downstream ribs 42. The upstream ribs 41 and the downstream ribs 42 constitute a record medium support portion in this embodiment.

On the upstream support face 44, a detection target portion 40, which projects upward in the vertical direction D3 and has a flat portion 40*a* formed thereon, its lateral direction being in parallel with the reciprocating direction D1, its upper side face in the vertical direction D3 being flat, and which enables detection of the adhesion state regarding ink mists, which are suspended particles, is provided. The detection target portion 40 is provided between two adjacent ones of the upstream ribs 41 which are arranged in the reciprocating direction D1. Further, the flat portion 40*a* is polished to a mirror-like state.

By allowing users to set the positions of the paper guides 10 and 11 in the reciprocating direction D1 in accordance with the width of print paper S in the reciprocating direction D1, the position where the print paper S is placed on the print support 3 shown in FIG. 1 is determined in accordance with the width of the print paper S in the reciprocating direction D1. Consequently, when the print paper S placed on the paper support 3 shown in FIG. 1 has been fed, the transportation area, within which the print paper S is to be transported on the support portion 45 shown in FIG. 3, is determined for each width of the print paper S.

A minimum range R1 shown in FIG. 3 indicates a transportation area in the reciprocating direction D1, within which the printer paper S having a minimum width in the transporting direction D1 among various kinds of the print paper S available for the printer 1 is transported in the transporting direction D2. In the printer 1 according to this embodiment, the position of the minimum range R1 of the transportation area is located at the central portion in the reciprocating direction D1. The detection target portion 40 is provided inside the minimum range R1.

Figure 4:
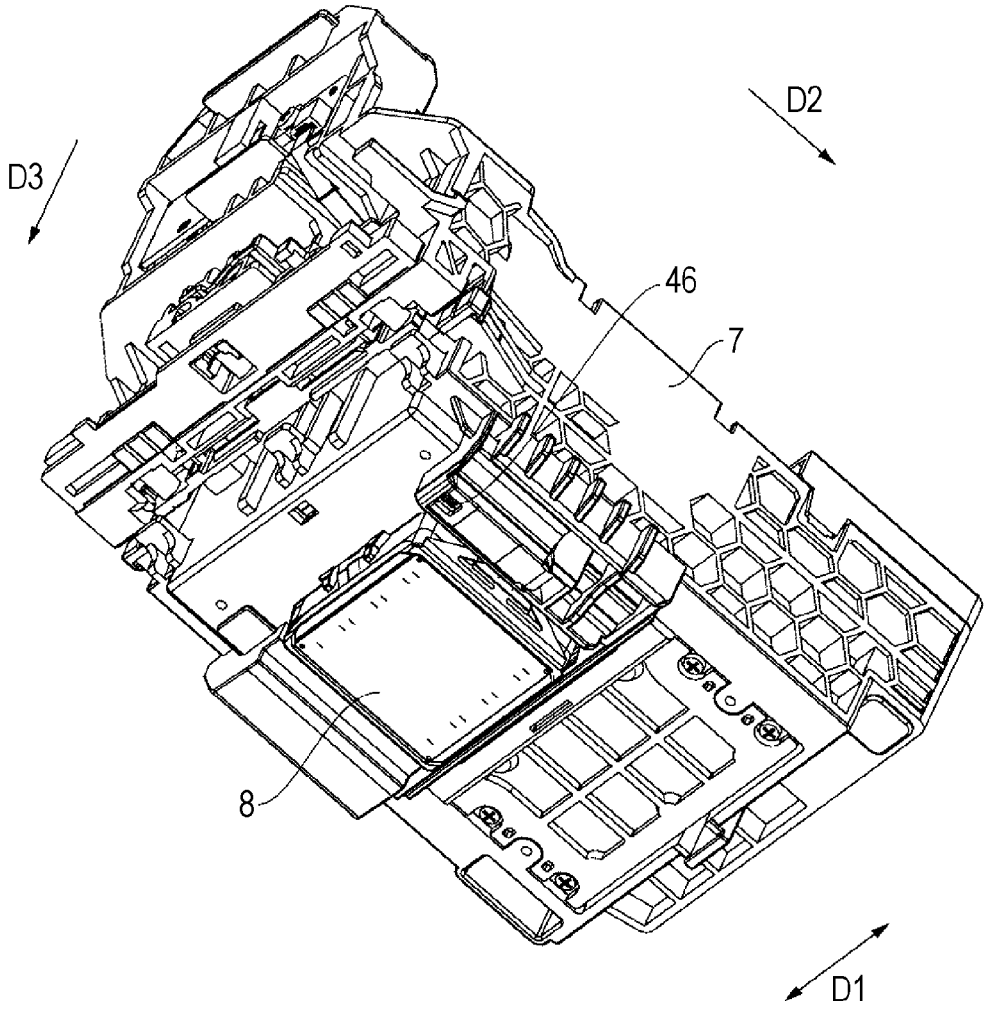
FIG. 4 is a sectional view of a carriage when viewed from below in the vertical direction, according to a first embodiment of the invention.

FIG. 4 is a perspective view of the carriage 7 when viewed from below in the vertical direction D3. At the lower portion of the carriage 7 in the vertical direction D3, the liquid electing head 8 is provided.

The arrow A shown in FIG. 3 indicates a liquid ejection area in the transporting direction D2 inside the support portion 45 toward which ink is ejected from the liquid ejecting head 8 shown in FIG. 4.

The liquid ejection area A is located on the downstream support face 43, and further, is located further downstream than the upstream support face 44 in the transporting direction D2. Therefore, the detection target portion 40 provided on the upstream support face 44 is located further upstream than the liquid ejection area A in the transporting direction D2. Accordingly, it is possible to suppress the adhesion of ink ejected from the liquid ejecting head 8 to the flat portion 40*a* of the detection target portion 40.

Figure 5:
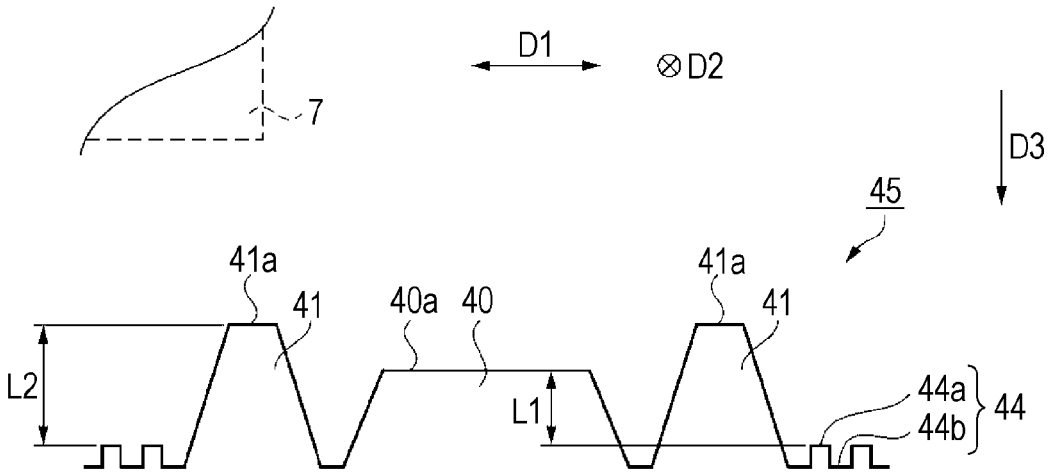
FIG. 5 is a sectional view of a detection target portion and an upstream rib according to a first embodiment of the invention.

FIG. 5 is a sectional view of the detection target portion 40 and the upstream ribs 41 provided on the upstream support face 44 when viewed downstream from a position denoted by the dotted line M shown FIG. 3 in the transporting direction D2. On the upstream support face 44, convex portions 44*a* and concave portions 44*b* extending in the transporting direction D2 are formed.

A height L1 from the convex portion 44*a*, which is an example of a lower side portion, to the flat portion 40*a* of the detection target portion 40 is smaller than a height L2 from the convex portion 44*a* to an edge portion 41*a* of the upstream rib 41.

That is, in the vertical direction D3, the position of the flat portion 40*a* of the detection target portion 40 is lower than that of the edge portion 41*a* of the upstream rib 41, and is higher than that of the convex portion 44*a* of the upstream support face 44. That is, the flat portion 40*a* of the detection target portion 40 is located at the carriage 7 side relative to the upstream support face 44, and is located at the upstream support face 44 side, i.e., at the side opposite the carriage 7, relative to the edge portion 41*a* of the upstream rib 41.

In this way, when the print paper S is transported in the transporting direction D2, it is possible to suppress the contact of the flat portion 40*a* of the detection target portion 40 with the print paper S, and thus, it is possible to prevent the damage of the flat portion 40*a* of the detection target portion 40 due to the friction with the print paper S.

Figure 6:
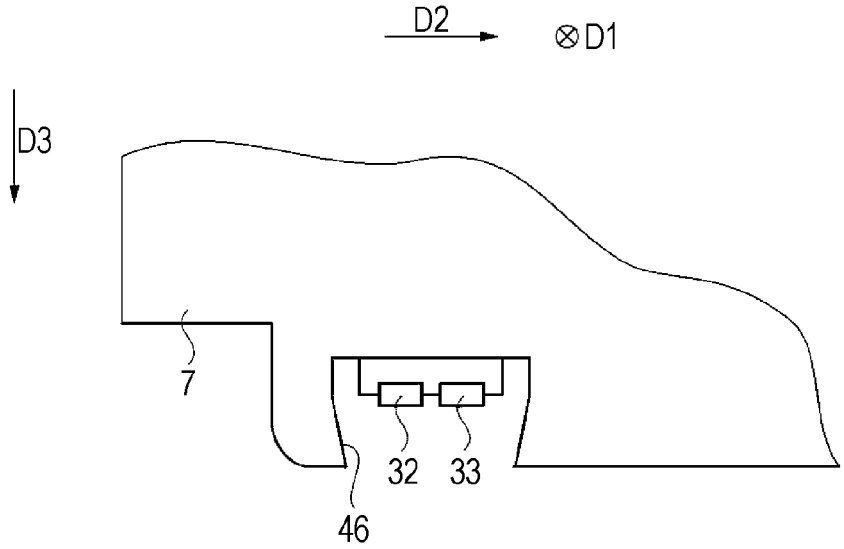
FIG. 6 is a sectional view of a light emitting unit and a light receiving unit included in a carriage according to a first embodiment of the invention.

FIG. 6 is a sectional view illustrating a light emitting unit 32 and a light receiving unit 33 included in the carriage 7. At the lower portion of the carriage 7 in the vertical direction D3, a sensor opening portion 46 is formed. The sensor opening portion 46 includes the light emitting unit 32, such as a light emitting diode, and the light receiving unit 33, such as a phototransistor.

The light emitting unit 32 and the light receiving unit 33 are electrically connected to the CPU 26, and the CPU 26 performs control of the light emitting function of the light emitting unit 32 and the light receiving function of the light receiving unit 33. Light rays emitted from the light emitting unit 32 illuminate the upstream support face 44 through the sensor opening portion 46, and light rays reflected at the upstream support face 44 can be received by the light receiving unit 33 through the sensor opening portion 46.

The sensor opening portion 46 is provided further upstream than the liquid ejecting head 8 in the transporting direction D2. Further, the sensor opening portion 46 is located at a position corresponding to the position of the flat portion 40*a* of the detection target portion 40 in the transporting direction D2. Therefore, the CPU 26 moves the carriage 7 in the reciprocating direction D1 by driving the carriage motor 30, and can locate the sensor opening portion 46 at a position facing the flat portion 40*a* of the detection target portion 40.

Figure 7:
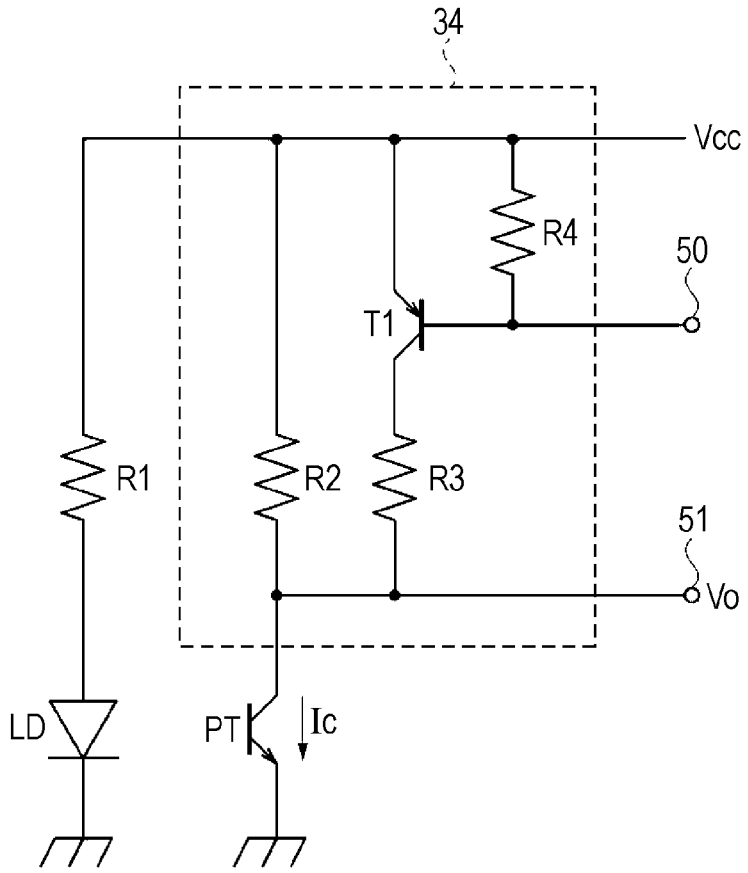
FIG. 7 is a circuit diagram illustrating a light emitting unit, a light receiving unit and a sensitivity setting circuit unit according to a first embodiment of the invention.

FIG. 7 is a circuit diagram illustrating a sensitivity setting circuit unit 34 for setting the sensitivity of the light receiving unit 33. A light emitting diode LD functioning as the light emitting unit 32 is grounded; the anode of the light emitting diode LD is electrically connected to one terminal of a resistor R1; and a power supply voltage Vcc is applied to the other terminal of the resistor R1.

When a phototransistor PT functioning as the light receiving unit 33 has received light rays, photocurrent Ic flows between the collector and the emitter of the phototransistor PT, and an output voltage Vo is detected at a terminal 51 which is electrically connected to the collector of the phototransistor PT.

The emitter of the phototransistor PT is grounded; the collector of the phototransistor PT is electrically connected to one terminal of a resistor R2; and the power supply voltage Vcc is applied to the other terminal of the resistor R2. Further, the collector of the phototransistor PT is electrically connected to one terminal of a resistor R3, and the collector of a transistor T1 is electrically connected to the other terminal of the resistor R3.

The power supply voltage Vcc is applied to the emitter of the transistor T1; the base of the transistor T1 is electrically connected to one terminal of a resistor R4; and the power supply voltage Vcc is applied to the other terminal of the resistor R4.

A terminal 50 is electrically connected to the base of the transistor T1. The CPU 26 applies a control signal to the base of the transistor T1 via the terminal 50, and thereby, can perform an operation of switching the connection between the collector and the emitter of the transistor T1 into a conductive state or a non-conductive state.

When the connection between the collector and the emitter of the transistor T1 is in the conductive state, electric current flows through the resistor R3. When the connection between the collector and the emitter of the transistor T1 is in the non-conductive state, any electric current does not flow through the resistor R3.

Therefore, since the resistor R2 is always in the conductive state, when the connection between the collector and the emitter of the transistor T1 is in the conductive state, electric current flows through the collector of the transistor PT via the resistor R2 and the resistor R3. When the connection between the collector and the emitter of the transistor T1 is in the non-conductive state, electric current flows through the collector of the transistor PT via the resistor R2.

The sensitivity setting circuit unit 34 is constituted of the resistors R2, R3 and R4, and the transistor T1. As described above, by using the control signal which is applied to the base of the transistor T1 via the terminal 50, the sensitivity setting circuit unit 34 selects whether electric current is to be flown through the resistor R3 electrically connected to the collector of the phototransistor PT, or not, and thereby, can set the sensitivity of the phototransistor PT.

Figure 8:
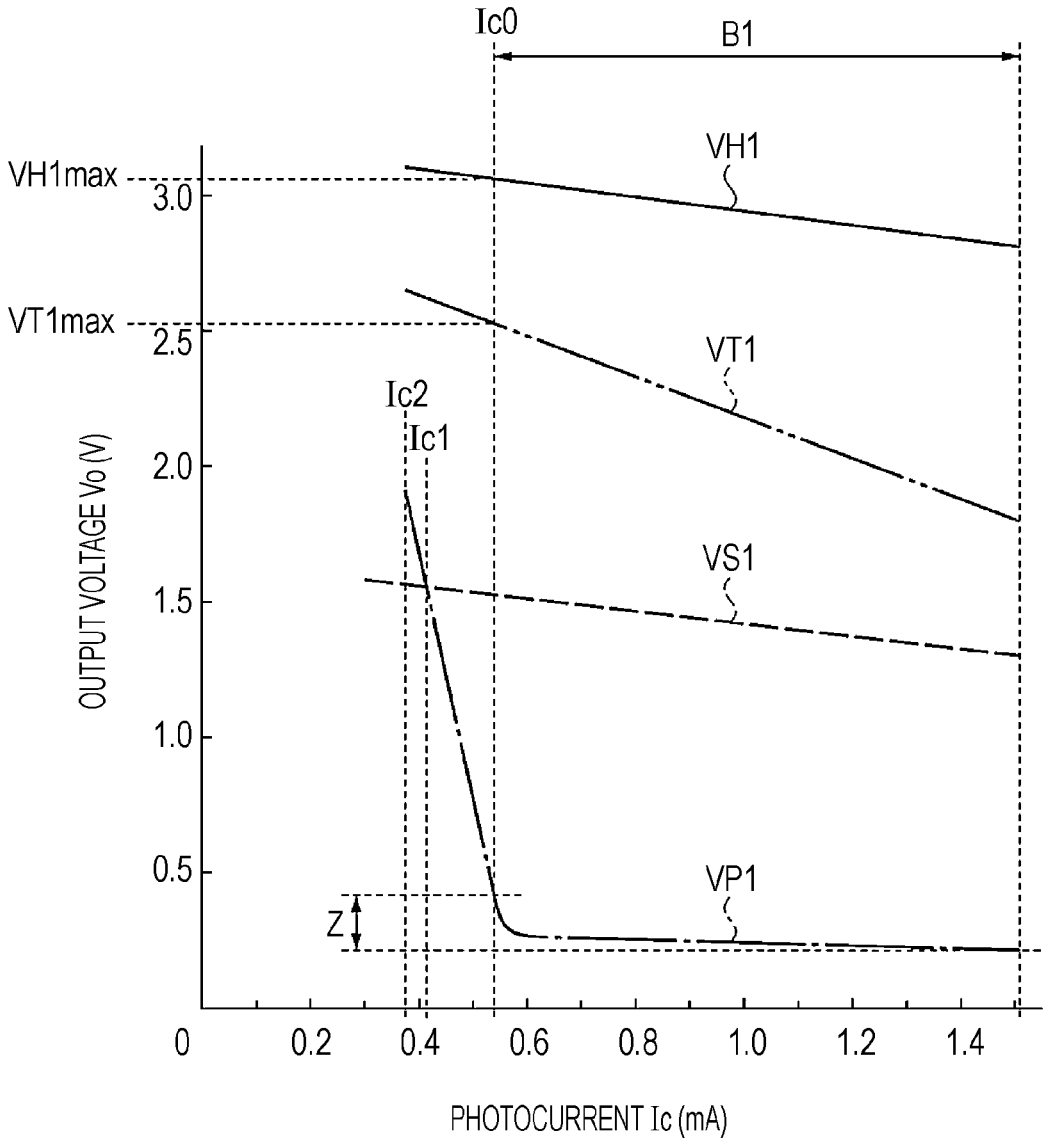
FIG. 8 is a graph illustrating variations of photocurrent and output voltages when a transistor is in a conductive state, according to a first embodiment of the invention.

FIG. 8 is a graph illustrating variations of the photocurrent Ic and the output voltage Vo under the state where the connection between the collector and the emitter of the transistor T1 is in the conductive state, so that electric current flows through each of the resistors R2 and R3.

The graph illustrated in FIG. 8 shows a state where the output Vo and the photocurrent Ic of the phototransistor PT vary along with the increase of the amount of ink mists adhered to the phototransistor PT. The progression of deterioration of the phototransistor PT caused by the increase of the amount of ink mists adhered to the phototransistor PT results in the decrease of the amount of the photocurrent Ic.

An output voltage VH1 denoted by the full line in FIG. 8 indicates the output voltage Vo which is outputted from the phototransistor PT shown in FIG. 7 when, under the state where the print paper S does not exist at a position covering the upstream support face 44 shown in FIG. 3, the phototransistor PT has received light rays reflected at the upstream support face 44 irradiated with light rays emitted from the light emitting diode LD.

An output voltage VP1 denoted by the one-dot chain line indicates the output voltage Vo which is outputted from the phototransistor PT when, under the state where the print paper S exists at a position covering the upstream support face 44, the phototransistor PT has received light rays reflected at the surface of the print paper S irradiated with light rays emitted from the light emitting diode LD.

A threshold value VS1 denoted by the dotted line indicates a value resulting from multiplying the output voltage VH1 by a predetermined ratio, and in this embodiment, the predetermined ratio is made, for example, 50 percent. An output voltage VT1 denoted by the two-dot chain line indicates the output voltage Vo which is outputted from the phototransistor PT when the phototransistor PT has received light rays reflected at the flat portion 40*a* of the detection target portion 40 shown in FIG. 3, irradiated with light rays emitted from the light emitting diode LD.

With the increase of the amount of ink mists adhered to the phototransistor PT, the photocurrent Ic decreases, and each of the output voltage VH1, the output voltage VP1, the threshold value VS1 and the output voltage VT1 increases.

Within a photocurrent range B1 regarding the photocurrent Ic, the output voltage Vo which is outputted from the phototransistor PT as the result of reflection at the surface of the print paper S is within a predetermined voltage increase range Z whose width is, for example, 0.2 V. When the photocurrent Ic decreases further, the output voltage Vo rapidly increases.

Within the photocurrent range B1 regarding the photocurrent Ic, when ordering the output voltage VP1, the threshold value VS1, the output voltage VT1 and the output voltage VH1 starting from a voltage having the smallest voltage level, its result is the same as the description order above. When the photocurrent Ic decreases further than the photocurrent range B1, the output voltage VP1 rapidly increases, so that the voltage value of the output voltage VP1 at a photocurrent amount value Ic1 becomes equal to that of the threshold value VS1 at the photocurrent amount value Ic1, and further, the voltage value of the output voltage VP1 at a photocurrent amount value Ic2, which is smaller than the photocurrent amount value Ic1, exceeds that of the threshold value VS1 at the photocurrent amount value Ic2.

Figure 9:
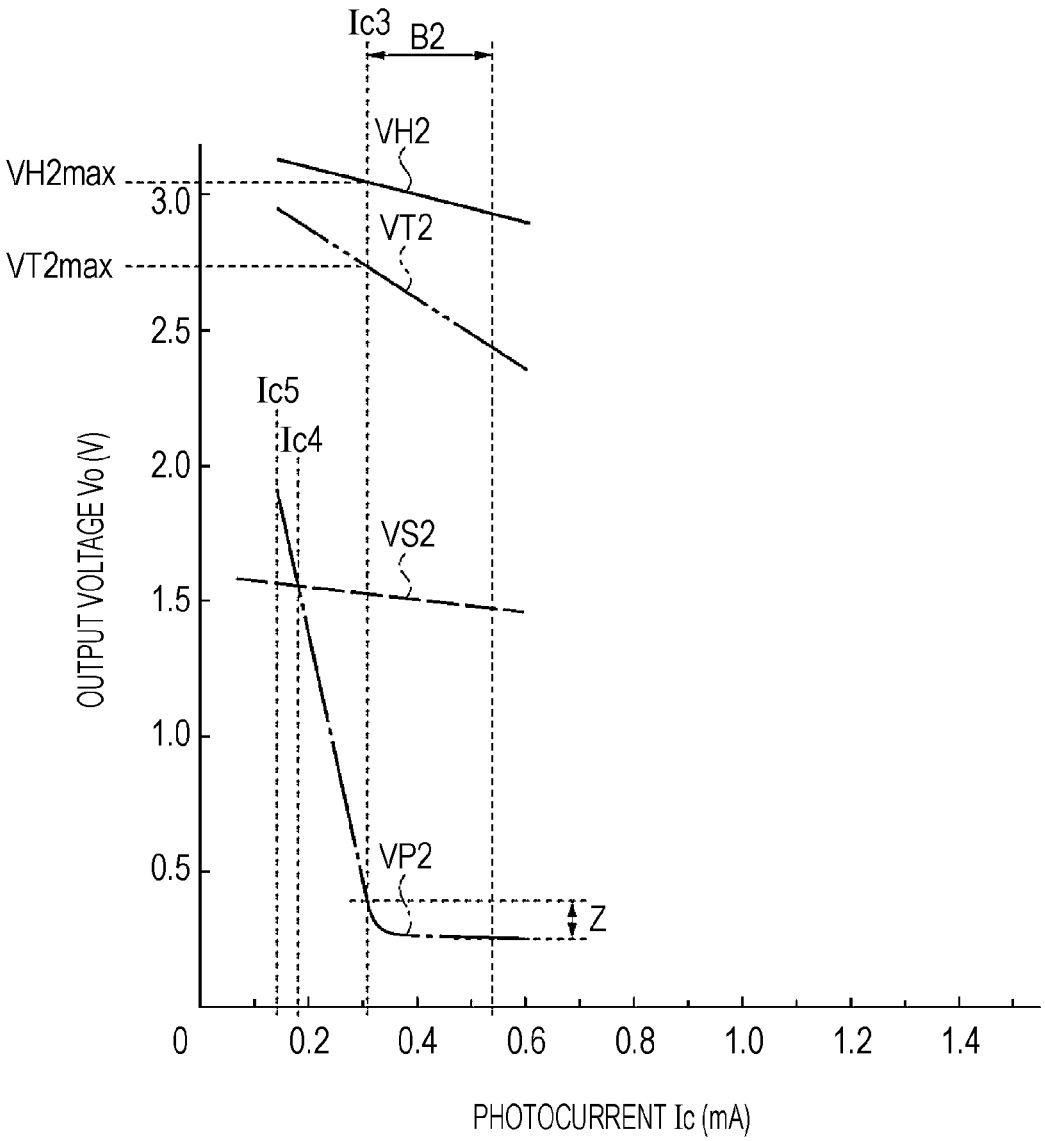
FIG. 9 is a graph illustrating variations of photocurrent and output voltages when a transistor is in a non-conductive state, according to a first embodiment of the invention.

FIG. 9 is a graph illustrating variations of the photocurrent Ic and the output voltage Vo under the state where the connection between the collector and the emitter is in the non-conductive state, so that electric current flows through the resistor R2, and any electric current does not flow through the resistor R3.

The graph illustrated in FIG. 9 shows a state where the output voltage Vo and the photocurrent Ic of the phototransistor PT vary along with the increase of the amount of ink mists adhered to the phototransistor PT. The progression of deterioration of the phototransistor PT caused by the increase of the amount of ink mists adhered to the phototransistor PT results in the decrease of the amount of the photocurrent Ic.

An output voltage VH2 denoted by the full line in FIG. 9 indicates the output voltage Vo which is outputted from the phototransistor PT shown in FIG. 7 when, under the state where the print paper S does not exist at a position covering the upstream support face 44 shown in FIG. 3, the phototransistor PT has received light rays reflected at the upstream support face 44 irradiated with light rays emitted from the light emitting diode LD.

An output voltage VP2 denoted by the one-dot chain line shown in FIG. 9 indicates the output voltage Vo which is outputted from the phototransistor PT when, under the state where the print paper S exists at a position covering the upstream support face 44, the phototransistor PT has received light rays reflected at the surface of the print paper S irradiated with light rays emitted from the light emitting diode LD.

A threshold value VS2 denoted by the dotted line indicates a value resulting from multiplying the output voltage VH2 by a predetermined ratio, and in this embodiment, the predetermined ratio is made, for example, 50 percent. An output voltage VT2 denoted by the two-dot chain line indicates the output voltage Vo which is outputted from the phototransistor PT when the phototransistor PT has received light rays reflected at the flat portion 40*a* of the detection target portion 40 shown in FIG. 3, irradiated with light rays emitted from the light emitting diode LD.

With the increase of the amount of ink mists adhered to the phototransistor PT, the photocurrent Ic decreases, and each of the output voltage VH2, the output voltage VP2, the threshold value VS2 and the output voltage VT2 increases.

Within a photocurrent range B2 regarding the photocurrent Ic, the output voltage Vo which is outputted from the phototransistor PT as the result of reflection at the surface of the print paper S is within a predetermined voltage increase range Z whose width is, for example, 0.2 V. When the photocurrent Ic decreases further, the output voltage Vo rapidly increases.

Within the photocurrent range B2 regarding the photocurrent Ic, when ordering the output voltage VP2, the threshold value VS2, the output voltage VT2 and the output voltage VH2 starting from a voltage having the smallest voltage level, its result is the same as the description order above. When the photocurrent Ic decreases further than the photocurrent range B2, the output voltage VP2 rapidly increases, so that the voltage value of the output voltage VP2 at a photocurrent amount value Ic4 becomes equal to that of the threshold value VS2 at the photocurrent amount value Ic4, and further, the voltage value of the output voltage VP2 at a photocurrent amount value Ic5, which is smaller than the photocurrent amount value Ic4, exceeds that of the threshold value VS2 at the photocurrent amount value Ic5.

In such a way as described above, by switching the sensitivity of the phototransistor PT, it is possible to cause a photocurrent amount value, at which the voltage value of the output voltage Vo outputted from the phototransistor PT having received reflected light rays from the surface of the print paper S becomes equal to that of a threshold value, to shift in a decrease direction from the photocurrent amount value Ic1 shown in FIG. 8 to the photocurrent amount value Ic4 shown in FIG. 9.

Additionally, it is possible to change a photocurrent range, which corresponds to the predetermined voltage increase range Z regarding the output voltage Vo outputted from the phototransistor PT as the result of reflection at the surface of the print paper S, from the photocurrent range B1 shown in FIG. 8 to the photocurrent range B2 shown in FIG. 9.

A minimum photocurrent amount value Ic3 within the photocurrent range B2 shown in FIG. 9 is smaller than a minimum photocurrent amount value Ic0 within the photocurrent range B1 shown in FIG. 8.

Therefore, notwithstanding the decrease of the photocurrent Ic due to the deterioration of the phototransistor PT, when the print paper S covers the upstream support face 44, any phenomenon, in which the voltage value of the output voltage VP2 outputted from the phototransistor PT having received reflected light rays from the surface of the print paper S exceeds the threshold value VS2, does not occur, and thus, it is possible to determine that the edge portion of the print paper S exists on the upstream support face 44 correctly. Accordingly, it is possible to determine the existence or non-existence of the print paper S by comparing the voltage value of the output voltage VP2 with the threshold value VS.

When the printer 1 is in an initial usage state, the phototransistor PT is made in the state where the sensitivity thereof is not switched. In this way, a false detection due to an excessive sensitivity of the phototransistor PT can be suppressed.

The sensitivity setting processing unit 25 shown in FIG. 2 acquires, as a first output voltage, the output voltage Vo outputted from the phototransistor PT having received light rays reflected at the flat portion 40*a* of the detection target portion 40 shown in FIG. 3, irradiated with light rays emitted from the light emitting diode LD.

A VT1max shown in FIG. 8 regarding the output voltage Vo indicates a maximum output voltage value of the output voltage VT1 within the photocurrent range B1.

The sensitivity setting processing unit 25 compares the acquired first output voltage with the maximum output voltage value VT1max. If the voltage value of the first output voltage is smaller than or equal to the maximum output voltage value VT1max, the sensitivity setting processing unit 25 makes the transistor T1 of the sensitivity setting circuit unit 34 shown in FIG. 7 be in the conductive state, and thereby, sets the state where electric current flows through each of the resistors R2 and R3. If the voltage value of the first output voltage is larger than the maximum output voltage value VT1max, the sensitivity setting processing unit 25 makes the transistor T1 be in the non-conductive state, and thereby, sets the state where any electric current does not flow through the resistor R3, and electric current flows through the resistor R2.

The content of processing performed by the edge portion detection processing unit 24 shown in FIG. 2 under the state where the transistor T1 is made in the conductive state by the sensitivity setting processing unit 25 and electric current is flowing through each of the resistors R2 and R3 will be described.

The edge portion detection processing unit 24 acquires, as a third output voltage, the output voltage Vo outputted from the phototransistor PT having received light rays reflected at the upstream support face 44 irradiated with light rays emitted from the light emitting diode LD.

The edge portion detection processing unit 24 compares whether the voltage value of the third voltage is smaller than the threshold value VS1 shown in FIG. 8, or not. If the voltage value of the third voltage is smaller than the threshold value VS1, it can be deemed that the output voltage VP1 shown in FIG. 8 resulting from reflection at the surface of the print paper S has been acquired, and thus, the edge portion detection processing unit 24 determines that the edge portion of the print paper S has been detected.

If the voltage value of the third voltage is larger than or equal to the threshold value VS1, it can be deemed that the output voltage VH1 resulting from reflection at the upstream support face 44 has been acquired, and thus, the edge portion detection processing unit 24 determines that the edge portion of the print paper S is not yet detected.

Next, the content of processing performed the edge portion detection processing unit 24 shown in FIG. 2 under the state where the transistor T1 is made in the non-conductive state by the sensitivity setting processing unit 25 and electric current is flowing through the resistor R2 will be described.

The edge portion detection processing unit 24 acquires, as a third output voltage, the output voltage Vo outputted from the phototransistor PT having received light rays reflected at the upstream support face 44 irradiated with light rays emitted from the light emitting diode LD.

The edge portion detection processing unit 24 compares whether the voltage value of the third voltage is smaller than the threshold value VS2 shown in FIG. 9, or not. If the voltage value of the third voltage is smaller than the threshold value VS2, it can be deemed that the output voltage VP2 shown in FIG. 9 resulting from reflection at the surface of the print paper S has been acquired, and thus, the edge portion detection processing unit 24 determines that the edge portion of the print paper S has been detected.

If the voltage value of the third voltage is larger than or equal to the threshold value VS2 shown in FIG. 9, it can be deemed that the output voltage VH2 resulting from reflection at the upstream support face 44 has been acquired, and thus, the edge portion detection processing unit 24 determines that the edge portion of the print paper S is not yet detected.

Figure 10:
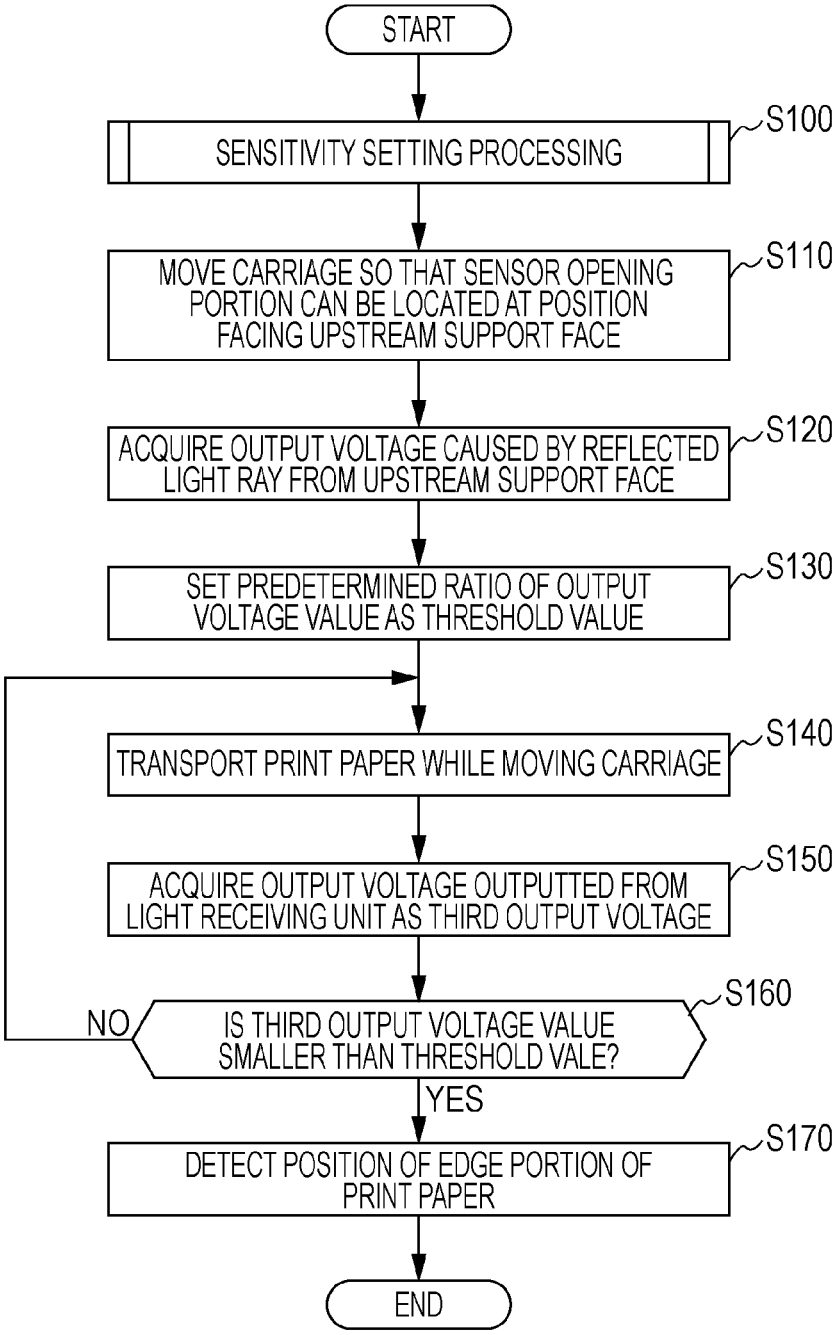
FIG. 10 is a flowchart illustrating processing performed by an edge portion detection processing unit and a sensitivity setting processing unit according to a first embodiment of the invention.

Next, processing performed by the edge portion detection processing 24 and the sensitivity setting processing 25 will be described by using a flowchart. FIG. 10 is a flowchart illustrating processing performed by the edge portion detection processing 24 and the sensitivity setting processing 25.

Under the initial use state of the printer 1, the transistor T1 of the sensitivity setting circuit unit 34 shown in FIG. 7 is made in the conductive condition, thereby causing electric current to flow through each of the resistors R2 and R3, and a sensitivity change flag described below is set to "OFF".

The sensitivity setting processing unit 25 performs sensitivity setting processing in step S100 shown in FIG. 10. The edge portion detection processing 24 performs processing from step S110 to step S170 shown in FIG. 10.

In step S110, the CPU 26 moves the carriage 7 so that the sensor opening portion 46 can be located at a position facing the upstream support face 44. In step S120, the CPU 26 acquires the output voltage Vo outputted from the light receiving unit 33 having received reflected light rays from the upstream support face 44 irradiated with light rays emitted from the light emitting unit 32.

In step S130, the CPU 26 sets a voltage value, which is equivalent to a predetermined ratio (for example, 50 percent) of the output voltage Vo having been acquired in step S120, as a threshold value.

In step S140, the CPU 26 causes the print paper S to be transported while causing the carriage 7 to move. In step S150, the CPU 26 acquires, as a third output voltage, the voltage Vo outputted from the phototransistor PT as the result of causing the light emitting diode LD to emit light rays toward the upstream support face 44.

In step S160, the CPU 26 determines whether the voltage value of the third output voltage is smaller than the threshold value having been set in step S130, or not. If the voltage value of the third output voltage is smaller than the threshold value (Yes), the CPU 26 determines that the edge portion of the print paper S has been detected, and then, causes the process flow to proceed to step S170. In step S170, the CPU 26 acquires a value of the amount of movement regarding the print paper S in the transporting direction D2, and thereby, detects the position of the edge portion of the print paper S.

In step S160, if the voltage value of the third output voltage is larger than or equal to the threshold value (No), the CPU 26 determines that the edge portion of the print paper S is not yet detected, and causes the process flow to return to step S140.

Figure 11:
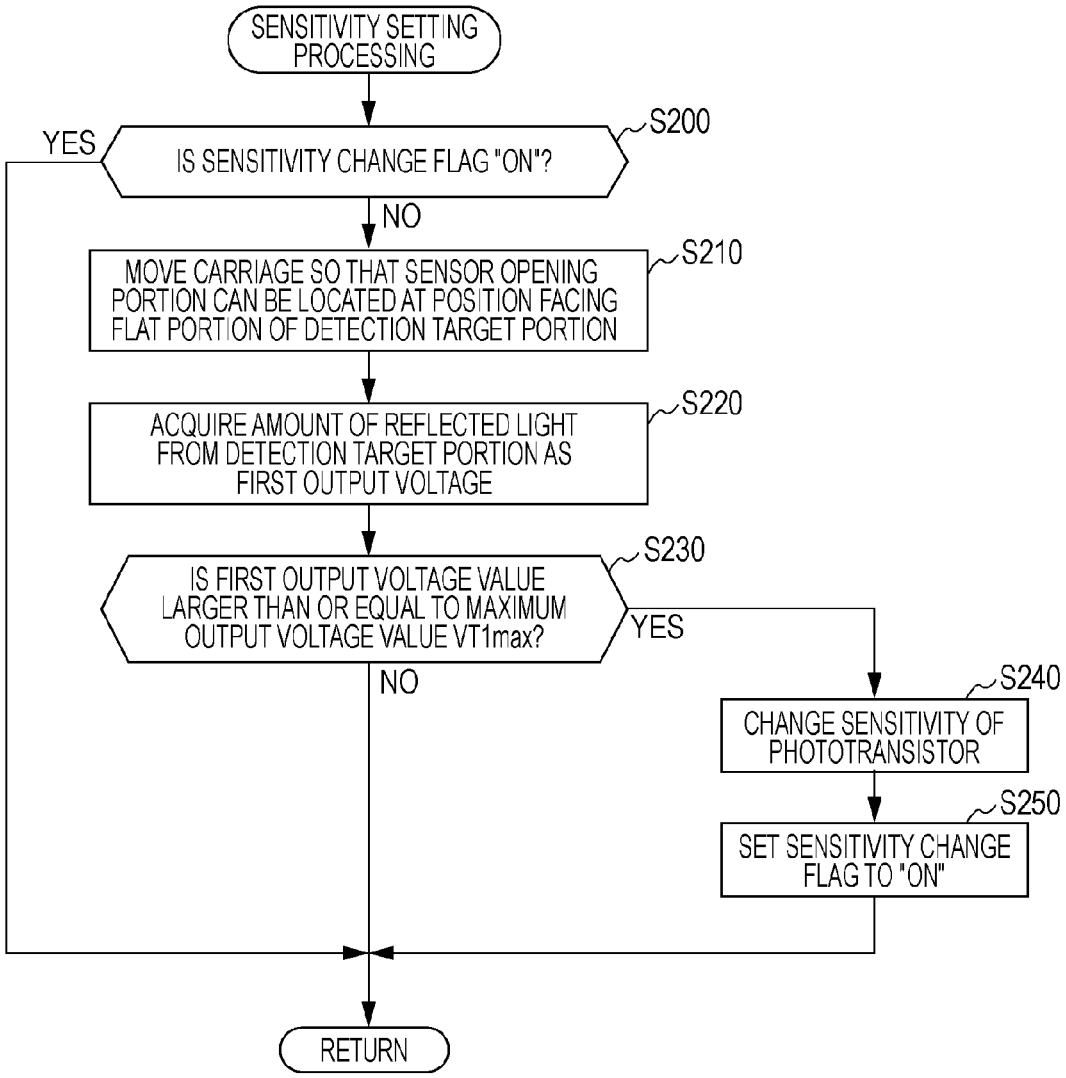
FIG. 11 is a flowchart illustrating a method of sensitivity setting processing according to a first embodiment of the invention.

FIG. 11 is a flowchart illustrating a method of the sensitivity setting processing in step S100 shown in FIG. 10. The sensitivity setting processing unit 25 performs processing from step S200 to step S250. In step S200, the CPU 26 determines whether the sensitivity change flag is "ON", or not. If the sensitivity change flag is "ON" (Yes), the CPU 26 terminates the process flow. If the sensitivity flag is "OFF" (No), the CPU 26 causes the process flow to proceed to step S5210.

In step S210, the CPU 26 moves the carriage 7 so that the sensor opening portion 46 can be located at a position facing the flat portion 40*a* of the detection target portion 40. In step S220, the CPU 26 acquires, as a first voltage, the output voltage Vo outputted from the light receiving unit 33 as the result of reflection at the flat portion 40*a* of the detection target portion 40.

In step S230, the CPU 26 determines whether the voltage value of the acquired first output voltage is larger than or equal to the maximum output voltage value VT1max, or not.

If the voltage value of the acquired first output voltage is larger than or equal to the maximum output voltage value VT1max (Yes), since the corresponding amount of the photocurrent Ic is smaller than the minimum photocurrent amount value Ic0 of the photocurrent range B1 regarding the photocurrent Ic, the CPU 26 causes the process flow to proceed to step S240. If the voltage value of the acquired first output voltage is smaller than the maximum output voltage value VT1max (No), since the corresponding amount of the photocurrent Ic is within the photocurrent range B1 regarding the photocurrent Ic, the CPU 26 causes the process flow to return to step S110.

In step S240, the CPU 26 changes the sensitivity of the phototransistor PT by using the sensitivity setting circuit unit 34 shown in FIGS. 2 and 7. That is, the CPU 26 makes the transistor T1 be in the non-conductive state, and thereby, sets the state where any electric current does not flow through the resistor R3, and electric current flows through the resistor R2. In step S250, the CPU 26 sets the sensitivity change flag provided on the nonvolatile memory 23 shown in FIG. 2 to "ON".

A sensitivity setting unit in this embodiment is configured to include the sensitivity setting processing unit 25 shown in FIG. 2 and the sensitivity setting circuit unit 34 shown in FIG. 7.

The printer 1, which has been described above in this embodiment, includes the carriage 7 which has the liquid ejecting head 8 for ejecting ink toward the print paper S being transported in the transporting direction D2, and which reciprocates in the reciprocating direction D1 intersecting with the transporting direction D2; the upstream ribs 41 and the downstream ribs 42 which project in the direction toward the carriage 7, and extend in the transporting direction D2, and which support the print paper S; the detection target portion 40 which is provided at the side opposite the carriage 7 relative to the carriage 7 side edge portion of the upstream rib 41, and which is used for detecting the adhesion state of ink mists which are suspended particles; the light emitting unit 32 and the light receiving unit 33 which are provided at positions at which they can face the detection target portion 40, respectively, the light emitting unit 32 emitting light rays, the light receiving unit 33 converting reflected light rays resulting from reflection of the emitted light rays into the photocurrent Ic; the edge portion detection processing unit 24 which detects the edge portion of the print paper S by comparing the third output voltage, which is outputted from the light receiving unit 33 as the result of irradiating the upstream support face 44 with light rays emitted from the light emitting unit 32, with a threshold value; and the sensitivity setting unit which locates the light emitting unit 32 and the light receiving unit 33 at a position facing the detection target portion 40, and performs setting the sensitivity of the light receiving unit 33 on the basis of the first output voltage outputted from the light receiving unit 33 having received reflected light rays from the detection target portion 40 irradiated with light rays emitted from the light emitting unit 32.

As having been described by using FIG. 8, when the transistor T1 shown in FIG. 7 is in the conductive state, regarding the photocurrent Ic flowing at the light receiving unit 33, there is provided the photocurrent range B1 within which the voltage value of the output voltage VP1 outputted from the light receiving unit 33 as the result of reflection at the surface of the print paper S is smaller than the threshold value VS1. Further, as having been described by using FIG. 9, when the transistor T1 shown in FIG. 7 is in the non-conductive state, regarding the photocurrent Ic flowing at the light receiving unit 33, there is provided the photocurrent range B2 within which the voltage value of the output voltage VP2 outputted from the light receiving unit 33 as the result of reflection at the surface of the print paper S is smaller than the threshold value VS2.

The sensitivity setting processing unit 25, shown in FIG. 2, included in the sensitivity setting unit moves the carriage 7 so that the light emitting unit 32 and the light receiving unit 33 can be located at positions facing the detection target portion 40, respectively; irradiates the detection target portion 40 with light rays emitted from the light emitting unit 32; causes the light receiving unit 33 to receive reflected light rays from the detection target portion 40 and output the first voltage; compares the voltage value of the first output voltage with the maximum output voltage value VT1max; and sets the sensitivity of the light receiving unit 33 in accordance with the comparison result by using the sensitivity setting circuit unit 34 shown in FIGS. 2 and 7.

Therefore, according to this configuration, regarding the photocurrent Ic flowing at the light receiving unit 33, it is possible to broaden the photocurrent range B1, within which the voltage value of the output voltage VP1 outputted from the light receiving unit 33 as the result of reflection at the surface of the print paper S is smaller than the threshold value VS1, to a photograph range including the photocurrent range B1, and the photocurrent range B2 within which the voltage value of the output voltage VP2 are smaller than the threshold values VS2.

Therefore, although the photocurrent Ic has degreased because of the increase of the amount of ink mists adhered to the light receiving unit 33, the edge portion detection processing unit 24 can detect the edge portion of the print paper S by comparing the voltage value of the third output voltage, which is outputted from the light receiving unit 33 as the result of causing the light emitting unit 32 to emit light rays toward the support portion 45, with a threshold value. Further, the flat portion 40*a*, which is the carriage 7 side edge face of the detection target portion 40 shown in FIG. 5, is located at the upstream support face 44 side relative to the carriage 7 side edge portion 41*a* of the upstream rib 41. Therefore, it is possible to suppress the wear of the flat portion 40*a* of the detection target portion 40, which is caused by the transported print paper S. In this way, it is possible to determine the state where the light receiving unit 33 has deteriorated because of ink mists adhered thereto on the basis of the first output voltage outputted from the light receiving unit 33 as the result of reflection at the flat portion 40*a* of the detection target portion 40.

Further, the detection target portion 40 is located, in the transporting direction D2, outside the liquid ejection area A onto which ink is ejected by the liquid ejecting head 8. According to this configuration, it is possible to prevent the adhesion of ink ejected from the liquid ejecting head 8 to the detection target portion 40.

Further, the detection portion 40 is located, in the reciprocating direction D1, inside the minimum range R1 of the transportation area of the support portion 45, within which the print paper S is transported. In this embodiment, the minimum range R1 is located at the central position of the support portion 45 in the reciprocating direction D1. According to this configuration, since the detection target portion 40 is covered by the print paper S in a transported state, it is possible to prevent the adhesion of ink mists to the detection target portion 40.

Further, on the detection target portion 40, the flat portion 40*a*, the lateral direction of which is in parallel with the reciprocating direction D1, is provided. According to this configuration, the reflectance regarding the reflection at the detection target portion 40 irradiated with light rays emitted from the light emitting unit 32 can be made higher.

Further, the flat portion 40*a* is polished to a mirror-like state. According to this configuration, the reflectance regarding the reflection at the detection target portion 40 irradiated with light rays emitted from the light emitting unit 32 can be made further higher.

The degree of the decrease of reflectance due to the adhesion of ink mists to the detection target portion 40 is larger than the degree of the decrease of the reflectance due to the adhesion of ink mists to the upstream support face 44. Therefore, the rising rate of the increase of the output voltage VT1 resulting from reflected light rays from the detection target portion 40 along with the increase of the amount of adhered ink mists is larger than the rising rate of the increase of the output voltage VH1 resulting from reflected light rays from the upstream support face 44 along with the increase of the amount of adhered ink mists. For this reason, in this embodiment, the deterioration state of the phototransistor PT is determined by using the maximum output voltage value VT1max shown in FIG. 8 resulting from reflected light rays from the detection target portion 40.

Second Embodiment

In the first embodiment, the deterioration state of the phototransistor PT has been determined by detecting the amount of reflected light rays from the flat portion 40*a* of the detection target portion 40 as the first output voltage outputted from the phototransistor PT; while, in this second embodiment, the amount of reflected light rays from the upstream support face 44 is detected as a second output voltage outputted from the phototransistor PT, and the deterioration state of the phototransistor PT is determined on the basis of the difference between the first output voltage and the second output voltage.

The voltage value denoted by VH1max shown in FIG. 8 regarding the output voltage Vo indicates a maximum output voltage value of the output voltage VH1 within the photocurrent range B1.

As shown in FIG. 8, the difference between the output voltage VH1 and the output voltage VT1 decreases along with the decrease of the photocurrent Ic. Therefore, it is determined whether the difference between the voltage value of the second output voltage detected as the result of reflection at the upstream support face 44 and the voltage value of the first output voltage detected as the result of reflection at the flat portion 40*a* is smaller than or equal to the difference between the maximum output voltage value VH1max and the maximum output voltage value VT1max shown in FIG. 8, or not.

Figure 12:
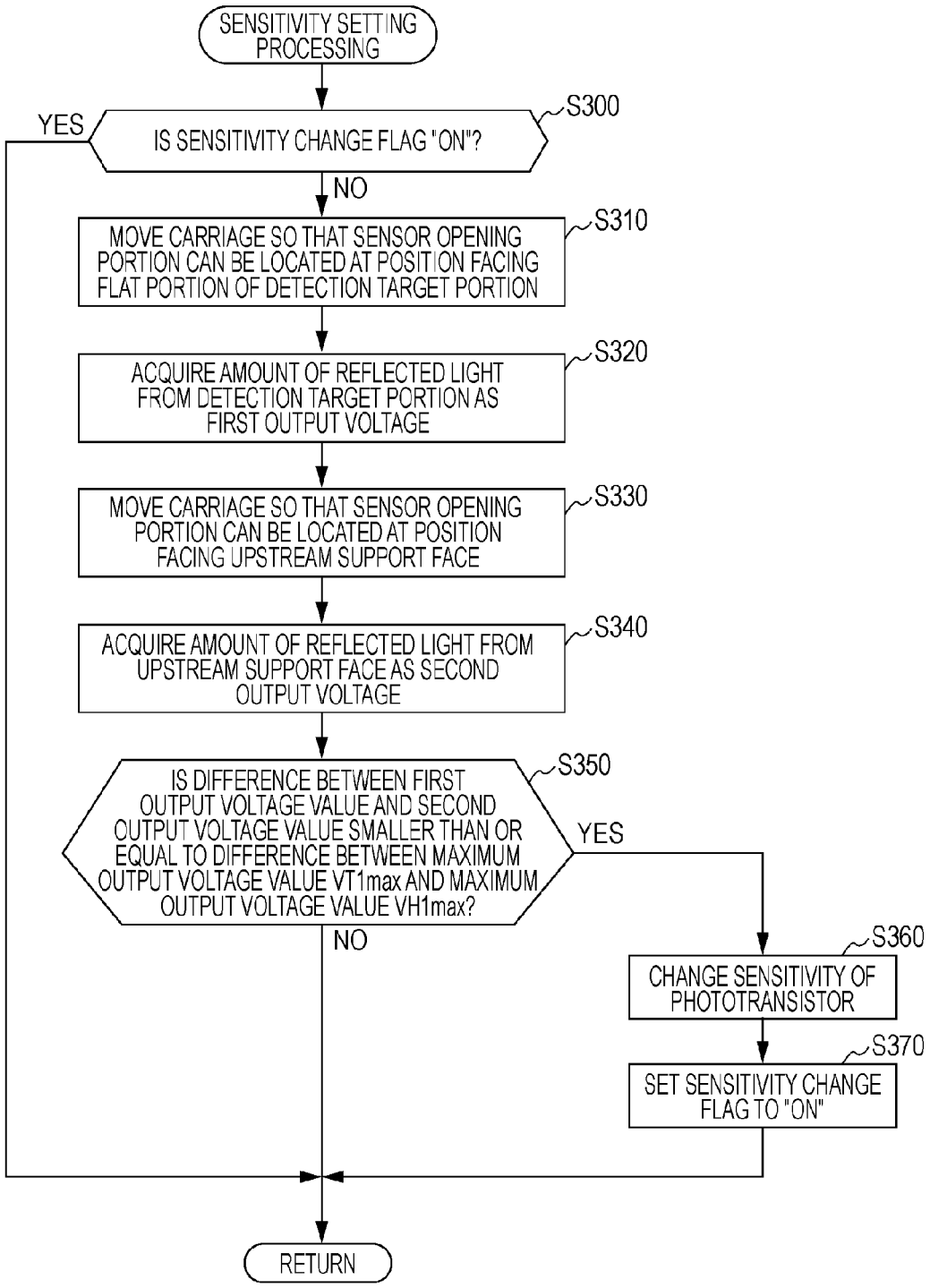
FIG. 12 is a flowchart illustrating a method of sensitivity setting processing according to a second embodiment of the invention.

A method of processing performed by the edge portion detection processing unit 24 and the sensitivity setting processing unit 25 in this embodiment will be described by using a flowchart. The flowchart for this embodiment is similar to that for the first embodiment shown in FIG. 10. FIG. 12 is a flowchart illustrating a method of sensitivity setting processing in step S100 of the flowchart shown in FIG. 10. The sensitivity setting processing unit 25 performs processing from step S300 to step S370.

In step S300, the CPU 26 determines whether the sensitivity change flag is "ON", or not. If the sensitivity change flag is "ON" (Yes), the CPU terminates the process flow. If the sensitivity change flag is "OFF" (No), the CPU causes the process flow to proceed to step S310.

In step S310 shown in FIG. 12, the CPU 26 moves the carriage 7 so that the sensor opening portion 46 can be located at a position facing the flat portion 40*a* of the detection target portion 40. In step S320, the CPU 26 acquires the amount of reflected light rays from the flat portion 40*a* of the detection target portion 40 as the first output voltage outputted from the phototransistor PT.

In step S330, the CPU 26 moves the carriage 7 so that the sensor opening portion 46 can be located at a position facing the upstream support face 44. In step S340, the CPU 26 acquires the amount of reflected light rays from the upstream support face 44 as the second output voltage outputted from the phototransistor PT.

In step S350, the CPU 26 determines whether the difference between the voltage value of the first output voltage and that of the second output voltage is smaller than or equal to the difference between the maximum output voltage value VH1max regarding the amount of reflected light rays from the upstream support face 44 and the maximum output voltage value VT1max regarding the amount of reflected light rays from the flat portion 40*a*.

In step S350, if the difference between the voltage value of the first output voltage and that of the second output voltage is smaller than or equal to the difference between the maximum output voltage value VH1max and the maximum output voltage value VT1max (Yes), the amount of the photocurrent Ic is smaller than the maximum photocurrent amount value Ic0 within the photocurrent range B1 regarding the photocurrent Ic shown in FIG. 8, and thus, the CPU 26 causes the process flow to proceed to step S360.

If the difference between the voltage value of the first output voltage and that of the second output voltage is larger than the difference between the maximum output voltage value VH1max and the maximum output voltage value VT1max (No), the amount of the photocurrent Ic is within the photocurrent range B1 regarding the photocurrent Ic shown in FIG. 8, and thus, the CPU 26 causes the process flow to return to step S110.

In step S360, the CPU 26 changes the sensitivity of the phototransistor PT by using the sensitivity setting circuit unit 34 shown in FIGS. 2 and 7. In step S370, the CPU 26 sets the sensitivity change flag provided on the nonvolatile memory 23 shown in FIG. 2 to "ON", and causes the process flow to return to step S110.

The other configuration of the printer according to this embodiment is the same as that of the printer 1 having been described in the first embodiment.

As described above, the sensitivity setting unit of the printer according to this embodiment acquires the first output voltage outputted from the light receiving unit 33 having received reflected light rays from the flat portion 40*a* of the detection target portion 40 irradiated with light rays emitted from the light emitting unit 32, and the second output voltage outputted from the light receiving unit 33 having received reflected light rays from the upstream support face 44 irradiated with light rays emitted from the light emitting unit 32, and sets the sensitivity of the light emitting unit 33 on the basis of the difference between the first output voltage and the second output voltage.

According to this configuration, it is possible to increase the accuracy of determination of the deterioration state due to the adhesion of ink mists.

Third Embodiment

Figure 13:
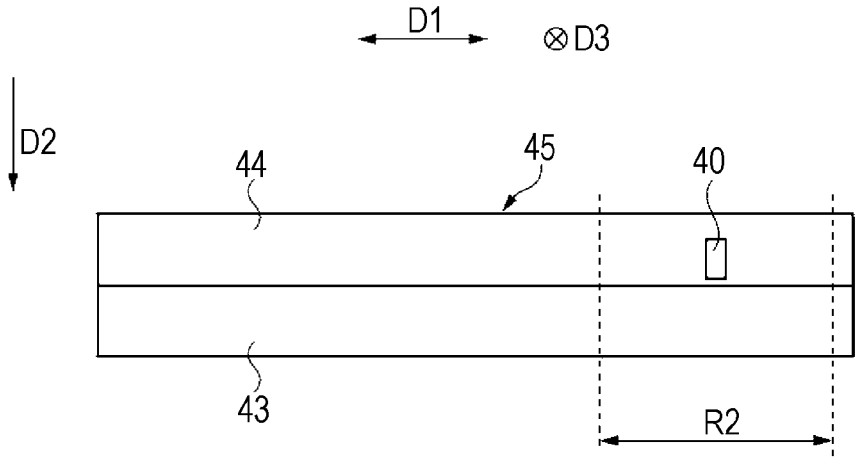
FIG. 13 is a diagram illustrating a minimum range of a transportation area according to a third embodiment of the invention.
Figure 14:
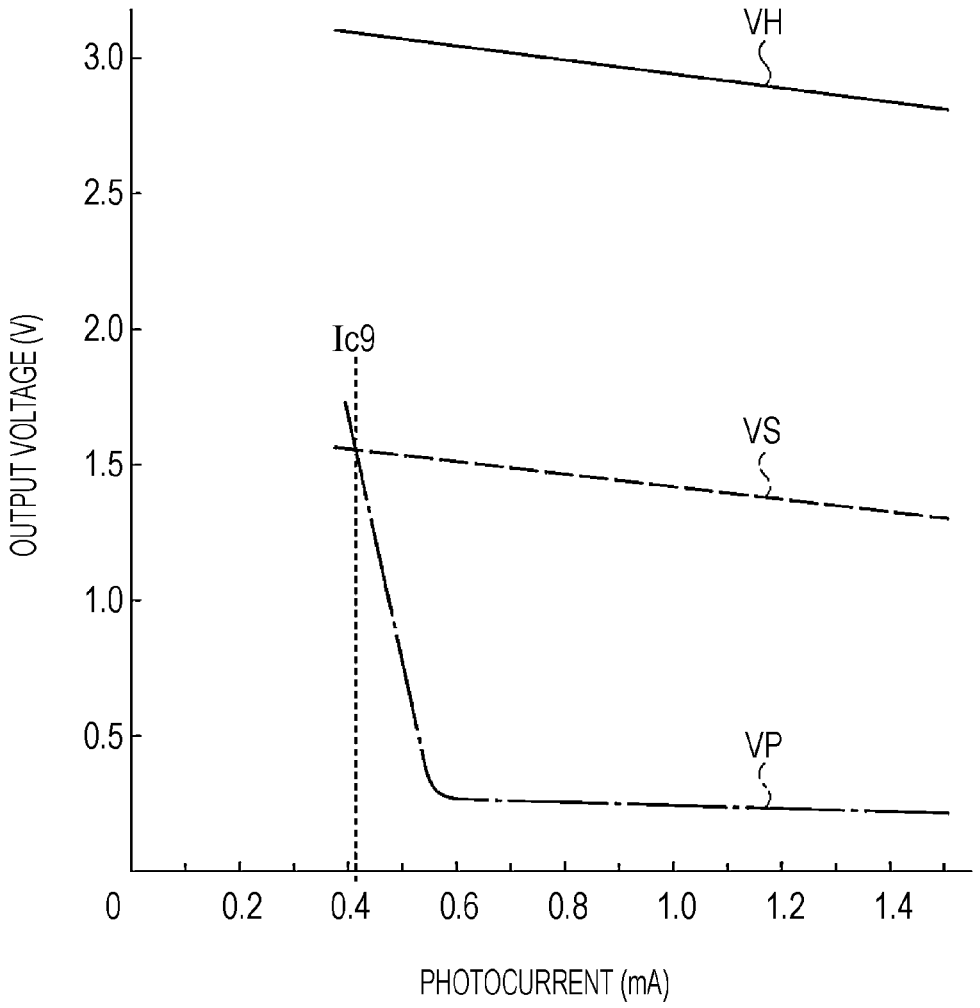
FIG. 14 is a graph illustrating photocurrent flowing at a light receiving unit and an output voltage outputted from a light receiving unit in an existing ink jet type printer.

FIG. 13 is a diagram illustrating a minimum range R2 of the transportation area when the support portion 45 is viewed from above in the vertical direction. In the first and second embodiments, the minimum range R1 of the transportation area regarding the print paper S in the reciprocating direction D1 is located at the central portion of the support portion 45 in the reciprocating direction, but the minimum range R2 of the transportation area may be located at only one side of the support portion 45 in the reciprocating direction.

The detection target portion 40 of the printer according to this embodiment is provided on the upstream support face 44 within the minimum range R2 of the transportation area. The other configuration of the printer according to this embodiment is the same as that of the printer 1 having been described in the first embodiment.

In the printer according to this embodiment, the minimum range R2 of the transportation area is located at only one side in the reciprocating direction D1. According to this configuration, the detection target portion 40 is covered by the print paper S in a transported state, and thus, it is possible to prevent the adhesion of ink mists to the detection target portion 40.

The detection target portion 40 according to the embodiments 1 to 3 projects in the direction from the upstream support face 44 to the carriage 7, but the detection target portion 40 may be formed so that the flat portion 40*a* thereof can be located at the same position in height as the upstream support face 44, or may be formed so that the flat portion 40*a* thereof can be located at a position opposite the carriage 7 relative to the upstream support face 44.

In the embodiments 1 to 3, the sensitivity of the light receiving unit 33 is upgraded upon determination of the deterioration of the light receiving unit 33 due to the adhesion of ink mists, but, when the ink mists adhered to the light receiving unit 33 have been eliminated by cleaning the light receiving unit 33, or the like, the sensitivity of the light receiving unit 33 may be downgraded.

Specific examples of the liquid ejecting apparatus can include liquid ejecting apparatus such as a liquid ejecting apparatus for ejecting liquid including materials, such as electrode materials or color materials, in the form of dispersion or dissolution, the materials being used in the production of a liquid crystal display, an electroluminescence (EL) display, a plane emission display, a color filter and the like; a liquid ejecting apparatus for ejecting living organic materials used in the production of biotips; a liquid ejecting apparatus which is used as an accurate pipette and ejects liquid to be handled as samples; a printing apparatus; and a micro-dispenser. Further, the liquid ejecting apparatus may be a liquid ejecting apparatus which ejects ink by using a line head and does not need the reciprocation of a carriage equipped with a liquid ejecting head.

Further, the processing target of the edge portion detection processing may be the front edge of a recording medium, or may be the right edge or the left edge of a recording medium.

What is claimed is:

1. A liquid ejecting apparatus comprising:

a liquid ejecting head which ejects liquid toward a recording medium;

a rib which projects in a direction toward the liquid ejecting head, and includes a support portion for supporting the recording medium;

a detection target portion which is provided at a position lower than the support portion;

a lower side portion located at a position lower than the detection target portion, wherein a height L1 from a top edge of the lower side portion to a flat portion of the detection target portion is less than a height L2 from the top edge of the lower side portion to an edge portion of the rib;

a light emitting unit which irradiates the detection target portion with light rays;

a light receiving unit which receives reflected light rays resulting from reflection of the light rays with which the detection target portion is irradiated, converts the received reflected light rays into photocurrent, and outputs the photocurrent as an output voltage; and a sensitivity setting unit which causes the light emitting unit to irradiate the detection target portion with light rays, causes the light receiving unit to receive reflected light rays resulting from reflection at the detection target portion and output a first output voltage, and sets the sensitivity of the light receiving unit on the basis of the first output voltage, wherein the sensitivity setting unit compares the first output voltage with a threshold value and sets a sensitivity setting circuitry of the light receiving unit to be in one of a conductive state or a non-conductive state based on the comparison.

2. The liquid ejecting apparatus according to claim 1, wherein the sensitivity setting unit causes the light emitting unit to irradiate the lower side portion with light rays, causes the light receiving unit to receive reflected light rays resulting from reflection at the lower side portion and output a second output voltage, acquires the second output voltage, and sets the sensitivity of the light receiving unit on the basis of a difference between the first output voltage and the second output voltage.

3. The liquid ejecting apparatus according to claim 1, wherein the detection target portion is located at a position outer than a liquid ejection area, onto which liquid is ejected by the liquid ejecting head, in a transporting direction along which the recording medium is transported.

4. The liquid ejecting apparatus according to claim 1, further comprising:

a carriage which reciprocates in a direction intersecting with the transporting direction along which the recording medium is transported, wherein the detection target portion is located inside a transportation area, within which the recording medium is transported, in the reciprocating direction.

5. The liquid ejecting apparatus according to claim 4, wherein the transportation area is located at a central portion in the reciprocating direction.

6. The liquid ejecting apparatus according to claim 4, wherein the transportation area is located at one side in the reciprocating direction.

7. The liquid ejecting apparatus according to claim 1, wherein the detection target portion is provided with a flat portion.

8. The liquid ejecting apparatus according to claim 7, wherein the flat portion is in a mirror-like state.

* * * * *